US010208612B2

(12) United States Patent
Olejarski et al.

(10) Patent No.: US 10,208,612 B2
(45) Date of Patent: Feb. 19, 2019

(54) GAS TURBINE SEALING BAND ARRANGEMENT HAVING AN UNDERLAP SEAL

(71) Applicant: Siemens Energy, Inc., Orlando, FL (US)

(72) Inventors: Michael J. Olejarski, Merrit Island, FL (US); David J. Mitchell, Oviedo, FL (US); Christopher J. Muller, Oviedo, FL (US); Rebecca L. Kendall, Oviedo, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 1037 days.

(21) Appl. No.: 14/461,459

(22) Filed: Aug. 18, 2014

(65) Prior Publication Data

US 2016/0047263 A1 Feb. 18, 2016

(51) Int. Cl.
*F01D 11/00* (2006.01)

(52) U.S. Cl.
CPC ..... *F01D 11/005* (2013.01); *F01D 11/001* (2013.01); *F05D 2240/59* (2013.01)

(58) Field of Classification Search
CPC .. F01D 11/005; F01D 11/001; F05D 2240/59; F05D 2240/55
See application file for complete search history.

(56) References Cited

U.S. PATENT DOCUMENTS

| | | | | |
|---|---|---|---|---|
| 5,149,109 | A * | 9/1992 | Jelinek | F16J 15/067 277/631 |
| 6,315,301 | B1 * | 11/2001 | Umemura | F01D 11/005 277/545 |
| 7,549,845 | B2 * | 6/2009 | Uwami | F01D 11/005 277/630 |
| 7,581,931 | B2 | 9/2009 | Shaefer et al. | |
| 8,348,280 | B2 * | 1/2013 | Pandey | F01D 11/02 277/416 |
| 2009/0191050 | A1 | 7/2009 | Nereim et al. | |
| 2013/0104565 | A1 * | 5/2013 | Casavant | F01D 25/26 60/805 |

(Continued)

OTHER PUBLICATIONS

U.S. Appl. No. 14/155,585, filed Jan. 15, 2014, and entitled Gas Turbine Including Sealing Band and Anti-Rotation Device.

(Continued)

*Primary Examiner* — David E Sosnowski
*Assistant Examiner* — Eric J Zamora Alvarez

(57) ABSTRACT

A sealing band arrangement for a gas turbine including first and second adjoining rotor disks each including a disk arm having a slot. The sealing band arrangement includes at least one first seal strip segment located within the slots, wherein the seal strip segment includes first and second ends. The sealing band arrangement also includes a tab section that extends from the first end in order to form an underlap seal with an adjacent second seal strip segment. The underlap seal enables a thickness of the first and second ends to be substantially equivalent to a thickness of the first seal strip segment in order to improve wear life of the seal strip segment. The sealing band arrangement further includes at least one wide portion formed in the first seal strip segment wherein the wide portion is wider than a remaining portion of the first seal strip segment.

8 Claims, 5 Drawing Sheets

(56) References Cited

U.S. PATENT DOCUMENTS

| | | | | |
|---|---|---|---|---|
| 2014/0112766 | A1 | 4/2014 | Nereim et al. | |
| 2014/0119899 | A1* | 5/2014 | Nereim | F01D 5/06 415/173.1 |
| 2014/0119900 | A1 | 5/2014 | Gurao et al. | |

OTHER PUBLICATIONS

U.S. Appl. No. 13/789,802, filed Mar. 8, 2013, and entitled Gas Turbine Including Bellyband Seal Anti-Rotation Device.

* cited by examiner

GAS TURBINE SEALING BAND ARRANGEMENT HAVING AN UNDERLAP SEAL

CROSS REFERENCE TO RELATED APPLICATIONS

The entire disclosure of U.S. patent application Ser. No. 14/155,585, filed on Jan. 15, 2014, and entitled GAS TURBINE INCLUDING SEALING BAND AND ANTI-ROTATION DEVICE and that of U.S. patent application Ser. No. 13/789,802, filed on Mar. 8, 2013, and entitled GAS TURBINE INCLUDING BELLYBAND SEAL ANTI-ROTATION DEVICE are hereby incorporated by reference in their entirety.

FIELD OF THE INVENTION

The invention relates to sealing bands used in gas turbines, and more particularly, to a sealing band arrangement having at least one first seal strip segment that includes a tab section that extends from the first seal strip segment in order to form an underlap seal with an adjacent second seal strip segment.

BACKGROUND OF THE INVENTION

In various multistage turbomachines used for energy conversion, such as a gas turbine, a hot combustion gas expands through the turbine to produce rotational motion. Referring to FIG. 1, a gas turbine 10 is schematically shown. The turbine 10 includes a compressor 12, which draws in ambient air 14 and delivers compressed air 16 to a combustor 18. A fuel supply 20 delivers fuel 22 to the combustor 18 where it is combined with the compressed air 16 and the fuel 22 is burned to produce high temperature combustion gas 24. The combustion gas 24 is expanded through a turbine section 26, which includes a series of rows of stationary vanes and rotor blades. The combustion gas 24 causes the rotor blades to rotate to produce shaft horsepower for driving the compressor 12 and a load, such as an electrical generator 28. Expanded gas 30 is either exhausted to the atmosphere directly, or in a combined cycle plant, may be exhausted to atmosphere through a heat recovery steam generator.

The rotor blades are mounted to disks that are supported for rotation on a rotor shaft. Annular arms extend from opposed surfaces of adjoining disks to form pairs of annular arms each separated by a gap. A cooling air cavity is formed on an inner side of the annular arm pairs between the disks of mutually adjacent stages. In addition, a labyrinth seal may be provided on an inner circumferential surface of stationary vane structures that cooperate with the annular arms to form a gas seal between a path for the hot combustion gases and the cooling air cavity. Each annular arm includes a slot for receiving a sealing band, known as a "belly band", which spans the gap between each annular arm pair to stop a flow of cooling air from the cooling air cavity into a path for the combustion gas 24. The sealing band may include multiple seal strip segments that extend in a circumferential direction. Each segment is configured to allow for thermal expansion during operation of the gas turbine. After reaching operating temperature, the segments become interconnected at lapped or stepped ends. FIG. 2 depicts an exemplary overlap arrangement 31 between adjacent first 33 and second 35 segments. The first 33 and second 35 segments include top 37 and bottom 39 overlap portions, respectively. The top 37 and bottom 39 overlap portions are each approximately one-half the thickness of the remaining portions of a segment 33, 35.

The sealing band is subjected to harsh environments including thermal cycling and high frequency vibrations that cause fretting wear in the overlap portions 37, 39. This leads to an undesirable loss of sealing capability due to leakage around worn areas of the overlap portions 37, 39. In addition, differential pressure and cooling flow may generate dynamic vibration and cause "hammering" or impact wear that can accelerate fretting wear. Such wear necessitates field replacement of the segments, thus increasing operating costs. Therefore, it is desirable to extend the wear life of the segments of a sealing band.

SUMMARY OF INVENTION

A sealing band arrangement for a gas turbine including first and second adjoining rotor disks each including a disk arm having a slot. The sealing band arrangement includes at least one first seal strip segment located within the slots, wherein the seal strip segment includes first and second ends. The sealing band arrangement also includes a tab section that extends from the first end in order to form an underlap seal with an adjacent second seal strip segment. The underlap seal enables a thickness of the first and second ends to be substantially equivalent to a thickness of the first seal strip segment in order to improve wear life of the seal strip segment. The sealing band arrangement further includes at least one wide portion formed in the first seal strip segment wherein the wide portion is wider than a remaining portion of the first seal strip segment for limiting movement of the first seal strip segment within the slots.

Those skilled in the art may apply the respective features of the present invention jointly or severally in any combination or sub-combination.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
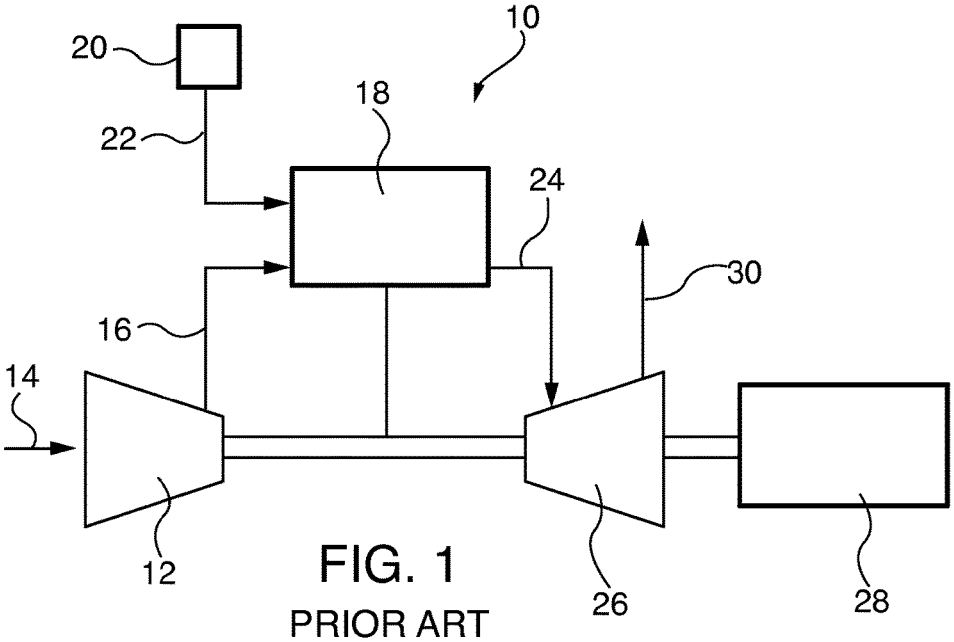
FIG. 1 PRIOR ART
FIG. 1 is a schematic representation of a gas turbine.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 3:
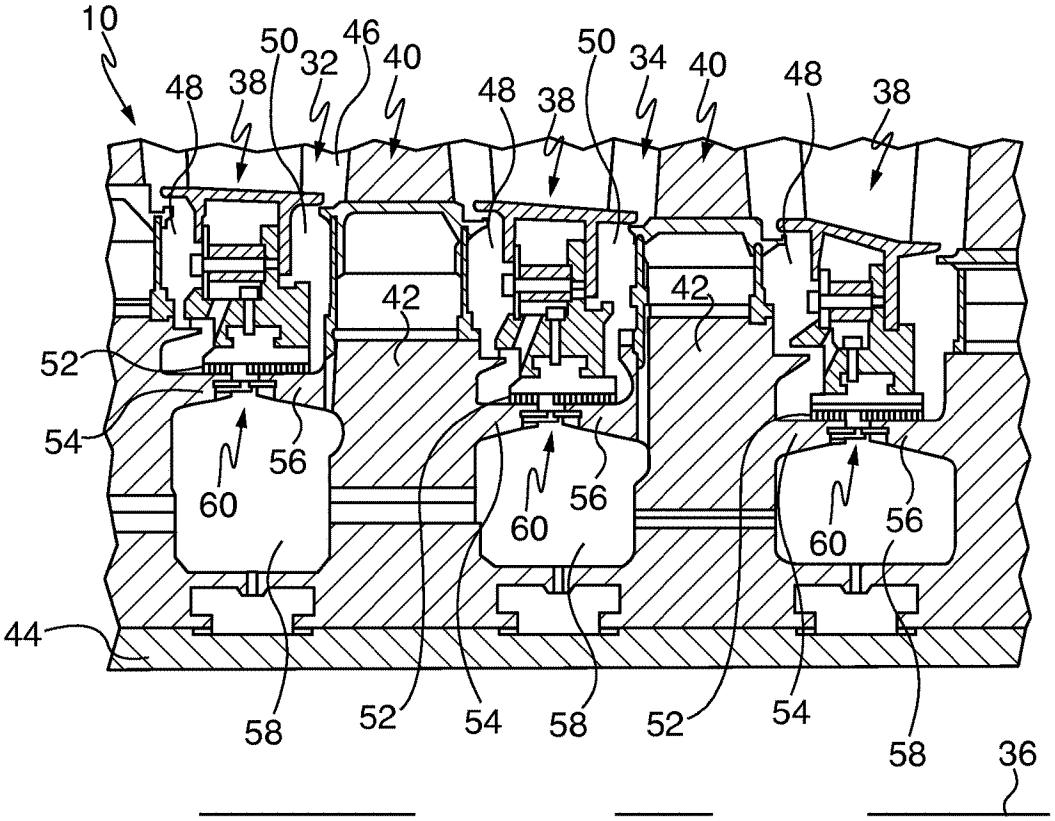
FIG. 3 is a partial cross sectional view of gas turbine.

Referring to FIG. 3, a partial cross sectional view of gas turbine 10 is shown. The gas turbine 10 includes adjacent stages 32, 34 oriented about an axis 36. Each of the stages 32, 34 includes a plurality of stationary vane assemblies 38 and a plurality of rotating blades 40. The vane assemblies 38 and blades 40 are positioned circumferentially within the gas turbine 10 with alternating arrays of vane assemblies 38 and blades 40 extending in an axial direction of the gas turbine 10. The blades 40 are supported on rotor disks 42 secured to adjacent disks with spindle bolts 44. The vane assemblies 38 and blades 40 extend into an annular gas passage 46. Hot gases directed through the gas passage 46 flow past the vane assemblies 38 and blades 40.

Disk cavities 48, 50 are located radially inward from the gas passage 46. Purge air is provided from cooling gas passing through internal passages in the vane assemblies 38 to the disk cavities 48, 50 to cool blades 40 and to provide a pressure to balance against the pressure of the hot gases in the gas passage 46. In addition, interstage seals including labyrinth seals 52, knife seals and/or brush seals are supported at a radially inner side of the vane assemblies 38 and are engaged with surfaces defined on paired annular disk arms 54, 56 that extend axially from opposed surfaces of adjoining disks 42.

An annular cooling air cavity 58 is formed between the opposed surfaces of adjoining disks 42 on a radially inner side of the paired annular disk arms 54, 56. The annular cooling air cavity 58 receives cooling air passing through disk passages to cool the disks 42. A sealing band 60 or "belly band" seal is positioned between the annular cooling air cavity 58 and the disk cavities 48, 50. The sealing band 60 prevents or substantially limits the flow of gases between the cooling air cavity 58 and the disk cavities 48, 50.

Figure 4:
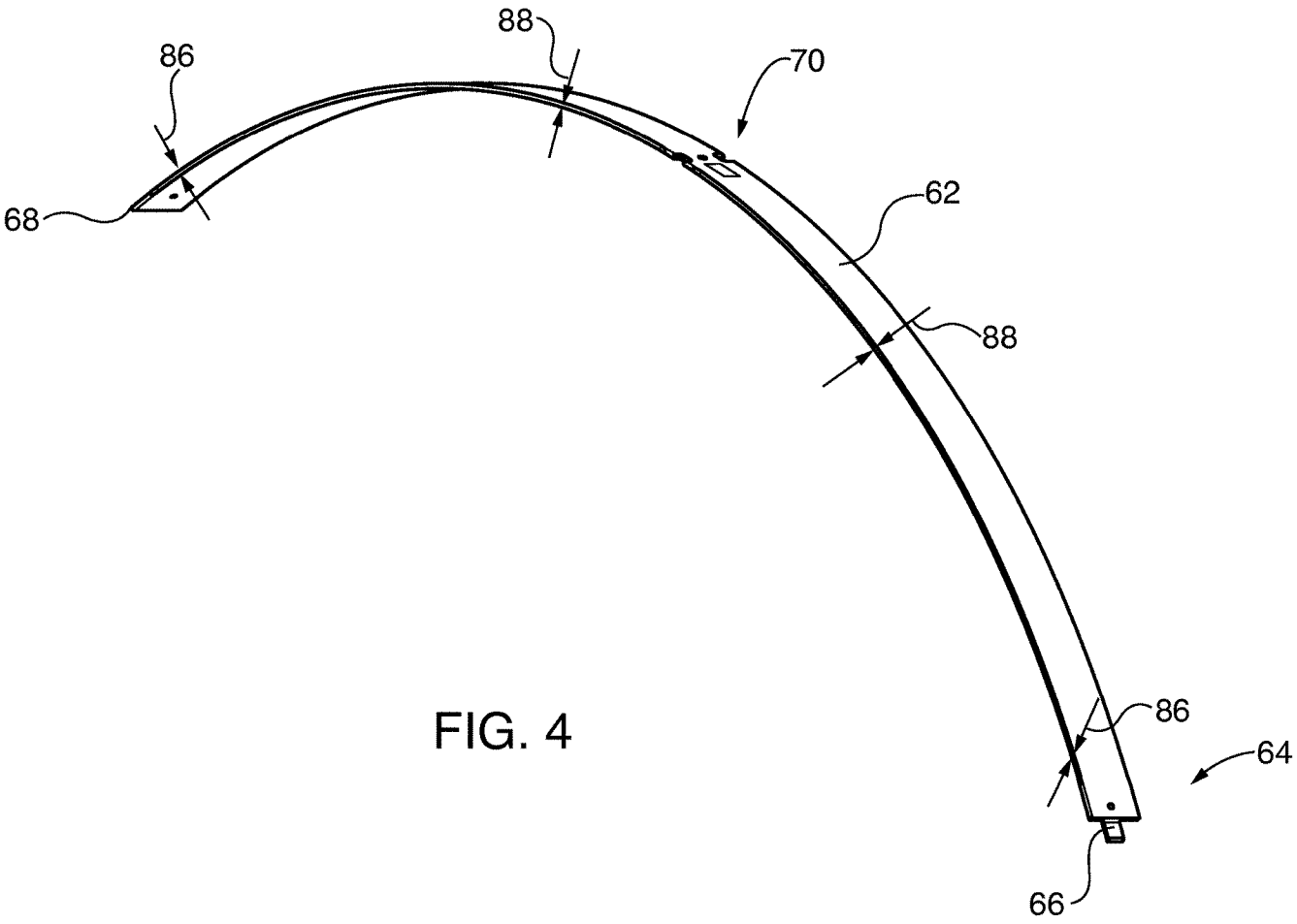
FIG. 4 is a perspective view of a seal strip segment in accordance with the invention.

The sealing band 60 may include a plurality of seal strip segments. Referring to FIG. 4, a perspective view of a seal strip segment 62 is shown. The seal strip segment 62 has a curved configuration and includes a first end 64 having a tab section 66 and a second end 68 for engaging a first end 64 of an adjacent seal strip segment 62. In accordance with the invention, a thickness 86 of the first 64 and second 68 ends is substantially equivalent to a thickness 88 of the remaining portions of the seal strip segment 62. In an embodiment, the thickness 86, 88 of the seal strip segment 62 is approximately 2.7 mm. The tab section 66 may be integrally or unistructurally formed to form a one-piece configuration. Alternatively, the tab section 66 may be attached to the first end 64 by welding, for example. Further, the seal strip segment 62 may be fabricated from a superalloy such as Haynes® 282® alloy in order to increase strength and reduce the likelihood of cracks. As will be described, an anti-rotation device may be attached to a center portion 70 of the seal strip segment 62.

Figure 5:
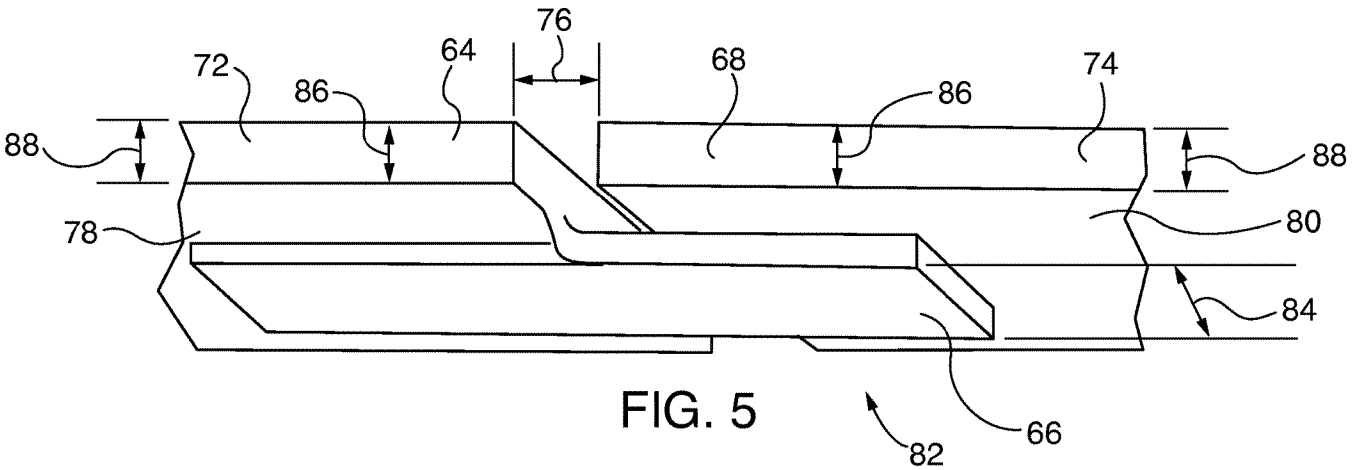
FIG. 5 depicts first and second ends of exemplary first and second seal strip segments, respectively.

FIG. 5 depicts first 64 and second 68 ends of exemplary first 72 and second 74 seal strip segments, respectively. The first 64 and second 68 ends are separated by a seal strip gap 76 to allow for thermal expansion during operation of the gas turbine 10. The tab section 66 extends from a radially inner surface 78 of the first seal strip segment 72 to underneath a radially inner surface 80 of the second seal strip segment 74. The tab section 66 provides sealing capabilities across the seal strip gap 76 thus forming an underlay) seal 82 for limiting the flow of gases between the cooling air cavity 58 and the disk cavities 48, 50 (see FIG. 2). In an embodiment, a width 84 of the tab section 66 is approximately 9.5 mm. The present invention enables the thickness 86 of the first 64 and second 68 ends to be substantially equivalent to the thickness 88 of the remaining portions of associated seal strip segments 72, 74, thus substantially improving wear life of the seal strip segments 72, 74.

Figure 6:
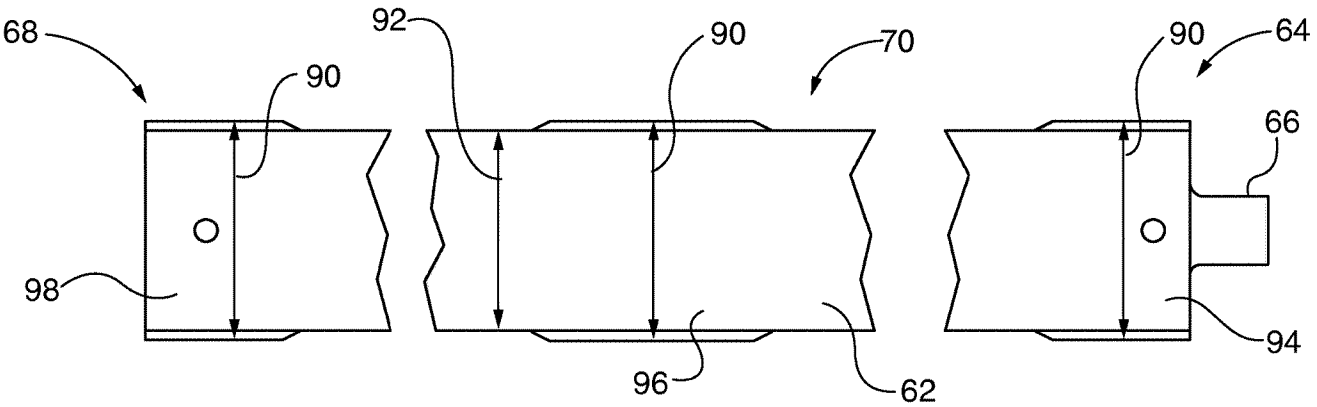
FIG. 6 depicts the first and second ends and the center portion of a seal strip segment.

Referring to FIG. 6, the first 64 and second 68 ends and the center portion 70 of the seal strip segment 62 are shown. In accordance with the invention, a width 90 of the first 64 and second 68 ends and the center portion 70 is larger than a width 92 of the remaining portions of the seal strip segment 62 thus forming first 94, second 96 and third 98 wide portions, respectively. By way of example, the width of the seal strip segment 62 is increased by approximately 2 mm at the first 94, second 96 and third 98 wide portions (i.e., 1 mm on each side of the seal strip segment 62). The wide portions 96, 98, 98 serve to limit movement of the seal strip segment 62 within slots that hold the seal strip segment 62. It is understood that the seal strip segment 62 may include additional or fewer wide portions.

Figure 2:
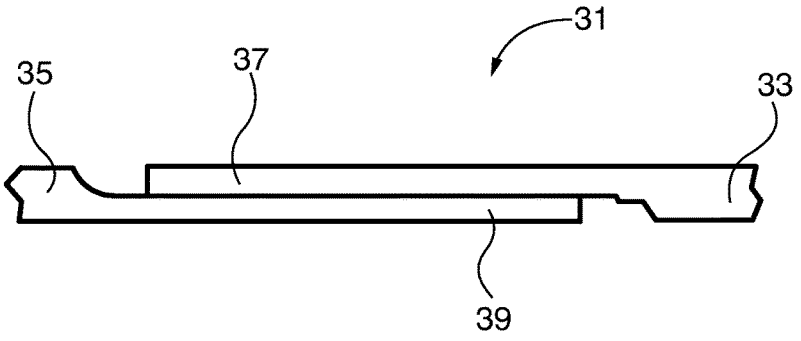
FIG. 2 PRIOR ART
FIG. 2 depicts an overlap arrangement between adjacent first and second seal strip segments.
Figure 7:
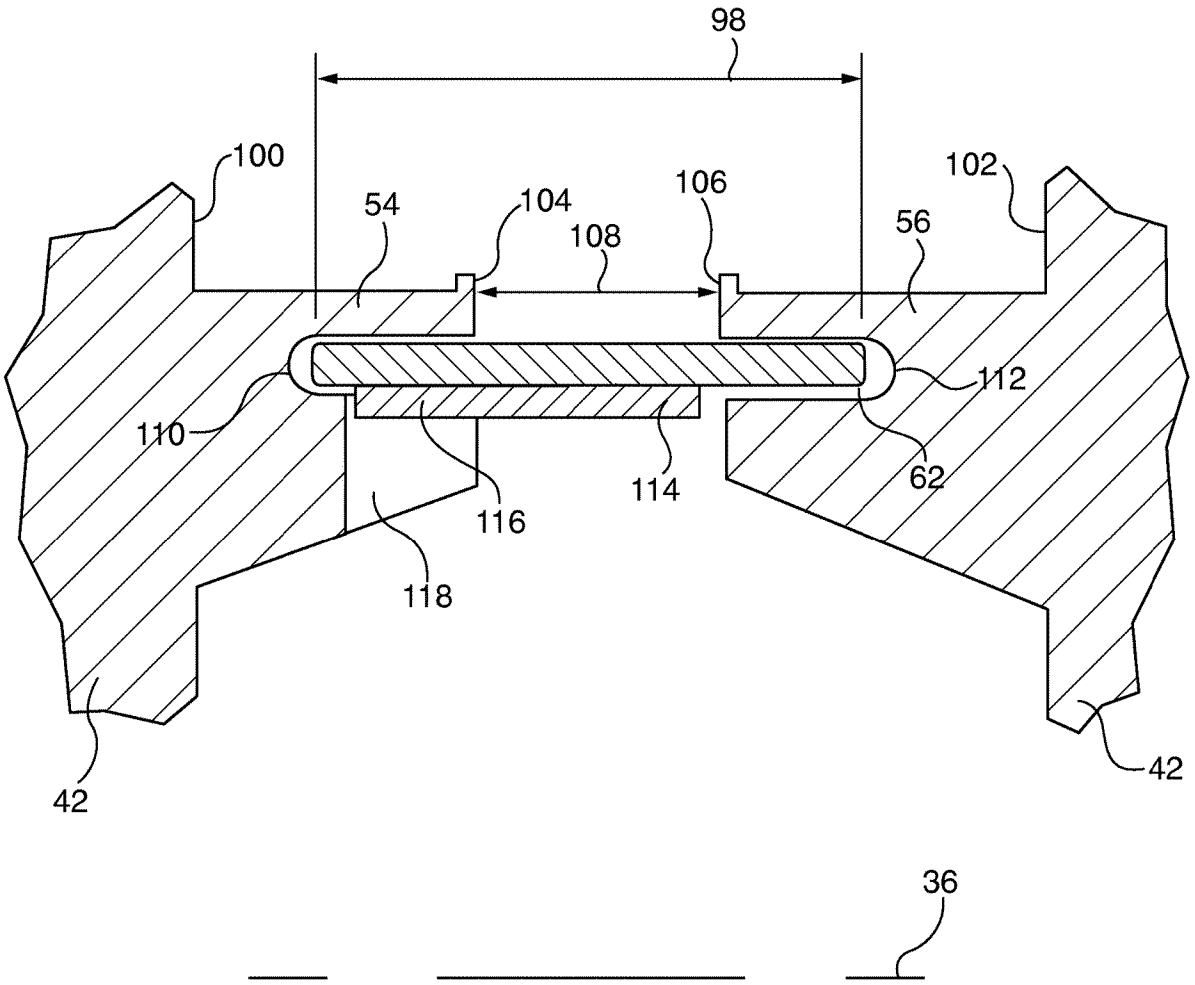
FIG. 7 shows the seal strip segment of the present invention located between exemplary annular disk arms of adjoining exemplary disks.

Referring to FIG. 7, the seal strip segment 62 is shown located between exemplary annular disk arms 54, 56 of adjoining exemplary disks 42 (see FIG. 2). The disks 42 and associated disk arms 54, 56 define an annular structure extending the full circumference about a rotor centerline. The disk arms 54, 56 extend from opposed surfaces 100, 102 respectively, of the disks 42. The disk arms 54, 56 include opposed end faces 104, 106, respectively, that are separated by an annular disk arm gap 108. A circumferentially extending slot 110, 112 is formed in the respective end faces 104, 106, wherein the slots 110, 112 are radially aligned with disk arm gap 108.

In FIG. 7, the third wide portion 98 of the seal strip segment 62 is shown positioned within the slots 110, 112 such that the seal strip segment 62 spans the disk arm gap 108 between the end faces 104, 106. As previously described, the wide portion 98 limits movement of the seal strip segment 62 within slots 110, 112.

An anti-rotation device 114 is attached to seal strip segment 62. The device includes a locking section 116 located in a notch or aperture 118 thrilled in disk arm 54. The device 114 inhibits or stops circumferential movement or shifting of the seal strip segment 62. The device 114 is attached to the center portion 70 of the seal strip segment 62. A gas turbine may include a plurality of seal strip segments 62 each including the device 114 to inhibit or stop circumferential movement of an associated seal strip segment 62. The plurality of seal strip segments 62 form the sealing band 60 for preventing or substantially limiting the flow of gases between the cooling air cavity 58 and the disk cavities 48, 50. In an embodiment, four seal strip segments 62 are used.

The sealing band 60 is compatible with existing gas turbine configurations currently being used thus enabling field replacement of a worn seal band with the seal band 60 or seal strip segments 62 of the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sealing band arrangement for a gas turbine, wherein the gas turbine includes first and second adjoining rotor disks each including a disk arm having a slot and wherein the disk arms are separated by a disk arm gap, comprising:

at least one first seal strip segment located within the slots, wherein the seal strip segment includes first and second ends;

at least one second strip segment adjacent to the first seal strip segment, the at least one second strip segment includes first and second ends; and a tab section extending from a radially inner surface of the first seal strip segment to underneath a radially inner surface of the second seal strip segment so that an underlap seal with the second end of the adjacent second seal strip segment is formed; and a plurality of wide portions formed in the first seal strip segment, wherein the plurality of wide portions are wider than a remaining portion of the first seal strip segment for limiting movement of the first seal strip segment within the slots wherein the plurality of wide portions are disposed only at the first and second ends of the first seal strip segment and at a center portion of the first seal strip segment, wherein a thickness of the first and second ends of the at least one first seal strip segment is substantially equivalent to a thickness of the first seal strip segment, and wherein a thickness of the first and second ends of the at least one second seal strip segment is substantially equivalent to a thickness of the second seal strip segment.

2. The sealing band arrangement according to claim 1, wherein the first end of the at least one first seal strip segment is separated from the second seal strip segment by a seal strip gap and the tab section seals the seal strip gap.

3. The sealing band arrangement according to claim 1, wherein the tab section is unistructurally formed with the first end.

4. The sealing band arrangement according to claim 1, wherein the tab section is approximately 9.5 mm wide.

5. The sealing band arrangement according to claim 1, wherein the first and second ends of the first seal strip segment are each approximately 2.7 mm thick.

6. The sealing band arrangement according to claim 1, wherein the sealing band arrangement includes four seal strip segments.

7. The sealing band arrangement according to claim 1, wherein the first and second seal strip segments each include an anti-rotation device.

8. The sealing band arrangement according to claim 1, wherein the at least one wide portion is approximately 2 mm wider than the remaining portion of the first seal strip segment.

* * * * *